United States Patent [19]

Wong

[11] Patent Number: 4,857,215

[45] Date of Patent: Aug. 15, 1989

[54] SEMI-FLUID LUBRICANT FOR EXTREME CLIMATES

[76] Inventor: John L. Wong, 9211 Darley Dr., Louisville, Ky. 40222

[21] Appl. No.: 77,283

[22] Filed: Jul. 24, 1987

Related U.S. Application Data

[63] Continuation-in-part of Ser. No. 844,033, Mar. 25, 1986, abandoned.

[51] Int. Cl.[4] ..... C10M 105/50; C10M 105/74

[52] U.S. Cl. ..... 252/32.500; 252/58

[58] Field of Search ..... 252/32.5, 58, 54, 48.8

[56] References Cited

U.S. PATENT DOCUMENTS

| | | | |
|---|---|---|---|
| 3,011,975 | 12/1961 | Nitzche | 252/58 X |
| 3,215,720 | 11/1965 | Atwood | 252/49.8 |
| 3,248,326 | 4/1966 | Swenson | 252/58 |
| 3,316,312 | 4/1967 | McCane | 252/58 X |
| 3,386,917 | 6/1968 | Schiefer | 252/49.8 |
| 3,427,245 | 2/1969 | Hotten | 252/49.8 |
| 3,432,437 | 3/1969 | Nail | 252/49.8 |
| 3,536,624 | 10/1970 | Christian | 252/58 X |
| 3,784,471 | 1/1974 | Kaiser | 252/58 X |
| 3,865,743 | 2/1975 | Sheratte | 252/49.9 X |
| 3,865,743 | 2/1975 | Sheratte | 252/58 |
| 3,907,697 | 9/1975 | Burrous | 252/49.9 X |
| 3,932,294 | 1/1976 | Burrous | 252/49.8 |
| 4,075,362 | 2/1978 | Cuncannon | 252/58 |
| 4,118,330 | 10/1978 | Hotten | 252/32.5 |
| 4,200,542 | 4/1980 | Liston | 252/32.7 E |
| 4,362,634 | 12/1982 | Beiens et al. | 252/498 |
| 4,472,290 | 9/1984 | Caporiccio | 252/58 X |
| 4,525,286 | 6/1985 | Reick | 252/58 |

FOREIGN PATENT DOCUMENTS

| | | | |
|---|---|---|---|
| 0132879 | 2/1985 | European Pat. Off. | 252/58 |
| 0213944 | 9/1984 | Fed. Rep. of Germany | 252/58 |
| 0141792 | 7/1985 | Japan | 252/49.8 |
| 6161489 | 7/1985 | Japan | 252/49.8 |

*Primary Examiner*—William R. Dixon, Jr.
*Assistant Examiner*—James M. Hunter, Jr.

[57] ABSTRACT

An extreme climate, semi-fluid lubricant comprising a homogeneous mixture of tri-(2-ethylhexyl) phosphate, about 30 percent to about 44 percent by weight, and the balance a grease comprising perfluorocarbon polymer is powder form suitable for use as a lubricant in combination with base oil and lubricant additives.

31 Claims, No Drawings

SEMI-FLUID LUBRICANT FOR EXTREME CLIMATES

HISTORY OF PATENT

This is a continuation-in-part of application Ser. No. 844,833, filed Mar. 25, 1986, abandoned.

BACKGROUND OF THE INVENTION

An air-cooled, blow-back operated, automatic weapon experienced erratic firing at temperatures down to −50° F. It was suspected that the lubricant used was unsuitable. The best type of lubricants tried were found to be polytetrafluoroethylene-based, namely, the LSAT as specified by MIL-L-46150 and the T-6 grease of Tribophysics Corporation. Both allow the weapons to function properly at ambient temperature. Neither is designed to meet the stringent requirement of the low temperatures.

Steel surface frictional phenomenon exists in the sliding mechanism of the weapons. Even the polished and chrome-plated surfaces of the cam lever and the bolt are not planar to within 1 micron. When they make rubbing contact with steel surfaces of the rail and receiver, which are also populated with minute roughnesses, the rough peaks on both surfaces undergo shearing, plowing, and welding actions, which account for friction and wear. Given that one of the sliding surfaces has a certain degree of elastic freedom, the motion may be not continuous and may be intermittent in nature, proceeding in a process of stick-slip. The stick is due to the higher static friction between the surfaces, and the slip to the lower kinetic friction during the slipping itself.

When these sliding surfaces are lubricated by applying hydrodynamic lubrication with lubricants such as LSAT, a hydrodynamic film in excess of 1 micron may be formed, which can completely separate surfaces moving relative to each other. Friction is at a practical minimum; that being due only to shearing of the lubricant film, which is a function of the viscosity of the interposed layer. Although viscosity is changed simultaneously by changes in the pressure, temperature, and rate of shear, the most marked effect is due to temperature. Roughly speaking, a lowering of temperature by 18° F. may double the viscosity. Hence, low temperatures in the −50° F. range pose a particular drag to hydrodynamic lubrication.

Boundary lubrication may apply in real-life situations involving high loads, variable speeds (jerky motion), or when a copious, continuous supply of lubricant is unavailable, as at low temperatures, when hydrodynamic lubrication may not be obtained. In that case, the relatively thick lubricant layer breaks down, and the surfaces are separated by boundary films of only molecular dimensions (less than 0.01 micron). The friction is now influenced by the chemical constitution of the lubricant, while the bulk viscosity plays little or no part in the frictional behavior on steel surfaces. At the juncture, boundary lubrication becomes the determining factor in whether seizure will take place or not. The coefficient of friction for unlubricated metal surfaces is about 1.0. The value of surfaces with suitable boundary films is of the order of 0.05–0.10, approaching the best of hydrodynamic lubrication. Teflon is an excellent boundary lubricant due to its low molecular cohesion, and may reduce the coefficient of friction to possibly 0.04.

The LSAT lubricant, covered by MIL-L-46150, contains 25% by weight of Teflon in a dibasic acid ester as the base oil. The torque built up in its presence, maximum 800 g-cm at −65° F., is apparently too high to facilitate the weapon firing at low temperatures. T-6 grease samples by Tribophysics did not function any better under these conditions. When a minimal amount of LSAT was brushed on as a thin film or when the T-6 spray, to which the thixotropic version of T-6 grease is related, was used, the weapon was found to fire normally in the cold. Therefore, the culprit of drag is the base oils which are probably transformed to a relatively stiff matrix when subjected to the extreme cold. This loss in lubricity apparently reduced the counter-recoil velocity and hence the erratic firing of the weapon was observed. Thin-film applications of lubricants are not practical under combat or various environmental conditions, including sand and dust. The need of an extreme climate lubricant suitable for general machine gun usage has not been met.

SUMMARY OF THE INVENTION

The present invention provides improvement of T-6 and LSAT by means of a neutral phosphoric acid alkyl ester, particularly by an alkyl phosphate having a freezing point below −20° C. and especially tri-(2-ethylhexyl) phosphate. While tri-(n-butyl) phosphate may be used, the former is preferred. New lubricants codenamed TW-25, prepared by this inventor using the T-6 grease as a constituent, have been tried. The firing experience was considered satisfactory, showing no double-loading, jamming, short recoils or any restriction at low temperatures. The new lubricants maintained their consistency like that of LSAT at 150° F. The new lubricants have functioned in sand and dust environments as well as LSAT which was already proven for this purpose. The new lubricants have functioned in salt water environments.

An extreme climate, semi-fluid lubricant comprises a homogeneous mixture of tri-(n-butyl) phosphate, or preferably tri-(2-ethylhexyl) phosphate, in about 25 percent to about 45 percent, or preferably 30 to 41 percent, by weight and the balance a grease comprising perfluorocarbon polymer in powder form suitable for use as a lubricant in combination with base oil and lubricant additive.

In the preferred extreme climate, semi-fluid lubricant, the grease comprises from about 5 percent to about 90 percent by weight of perfluorocarbon polymer particles in powder form suitable for use as a lubricant and from about 5 to 90 percent tricresyl phosphate.

In one extreme climate, semi-fluid lubricant, the grease comprises about 50 percent by weight of perfluorocarbon polymer particles and about 50 percent by weight of tricresyl phosphate as the base oil.

In one extreme climate, semi-fluid lubricant the grease comprises about 50 percent by weight of perfluorocarbon polymer particles and about 50 percent by weight of trimethylolpropane as the base oil.

One extreme climate, semi-fluid lubricant grease comprises about 50 percent perfluorocarbon polymer in powder form suitable for use as a lubricant and about 25 percent trimethylolpropane and 25 percent tricresyl phosphate and grease additives. In that embodiment, the grease comprises about 49 percent of the powder and about 24 percent of trimethylolpropane and about 24 percent of tricresyl phosphate.

One extreme climate semi-fluid lubricant comprises a homogeneous mixture of tri-(n-butyl) phosphate, or preferably tri(2-ethylhexyl) phosphate, in about 30 to 45 percent by weight and the balance a thixotropic lubricant containing perfluorocarbon polymer in powder form suitable for use as a lubricant and base oil.

In the extreme climate semi-fluid lubricant, the thixotropic lubricant comprises about 25 percent of perfluorocarbon polymer in a powder form and the remainder dibasic acid ester as the base oil, plus grease additives.

The dibasic acid ester is bis(2-ethylhexyl) sebacate and a lithium soap added in sufficient quantity to provide body sufficient to hold a shape of the thixotropic lubricant.

In one extreme climate semi-fluid lubricant of the invention the thixotropic lubricant comprises about 20 to about 55 percent by weight perfluorocarbon polymer and a base oil which is a mixture of dibasic acid ester, aryl phosphate ester, and trimethyloalkane.

Preferably, the dibasic acid ester is bis(2-ethylhexyl) sebacate, and aryl phosphate ester is tricresyl phosphate, and the trimethyloalkane is trimethylopropane.

The present invention provides a semi-fluid general purpose lubricant comprising an intimate mixture of about 1 to about 99 percent by weight of an alkyl phosphate having a freezing point below about −20 degrees Centigrade or a pour point below about zero degrees Centigrade and the balance comprising a thixotropic lubricant containing a perfluorocarbon polymer in powder form suitable for use as a lubricant and base oil.

In the semi-fluid general purpose lubricant, the preferred alkyl phosphate is tri-(2-ethylhexyl) phosphate or tri-(n-butyl) phosphate.

In the preferred semi-fluid general purpose lubricant the trialkyl phosphate is present in the range of from about 25 percent to about 50 percent by weight and the balance is the thixotropic lubricant.

The trialkyl phosphate is present preferably in the range of from about 40 percent to about 44 percent by weight, and the balance is the thixotropic lubricant.

The preferred semi-fluid general purpose lubricant has a thixotropic lubricant which contains perfluorocarbon polymer in powder form suitable for use as a lubricant and base oil selected from the group of base oils comprising a dibasic acid ester or a mixture of a dibasic acid ester, an aryl phosphate ester, and a trimethyloalkane.

In the preferred semi-fluid general purpose lubricant, the perfluorocarbon polymer is present in the range of from about 20 to about 55 percent by weight of the thixotropic lubricant.

In the preferred semi-fluid general purpose lubricant, the base oil is a mixture of about equal parts of tricresyl phosphate and trimethylolpropane and about 50% of the thixotropic lubricant is perfluorocarbon.

In the preferred semi-fluid general purpose lubricant, about 50% of the thixotropic lubricant is perfluorocarbon polymer particles in a size range of about 3 to about 20 microns.

Preferably, the semi-fluid general purpose lubricant wherein the trialkyl phosphate is tri-(2-ethylhexyl) phosphate or tri-(n-butyl) phosphate.

Tertiary esters of phosphoric acid with alcohols, the trialkyl phosphates, are good low-temperature lubricants. They have excellent lubricating properties particularly for steel-on-steel friction, and some have very low pour points and freezing points. In the range of boundary lubrication where the chemical composition of a lubricant is important, the phosphorus compounds appear to work through a chemical polishing mechanism. Along the hot spots developed, due to friction between two rubbing surfaces, local chemical reactions can occur between the phosphate and the metal. Such reaction forms a metal phosphide layer. The metal phosphides can also form eutectic mixtures with the metal which can spread under the high pressures occurring in the sliding act and polish the surface. The compounds or alloys formed in these reactions lead to a load redistribution due to plastic deformation. With these attributes, the trialkyl phosphates often function as extreme pressure additives. As an additive or a component of a synthetic lubricant, the electron-donor character of the phosphoryl bond in phosphoric acid esters lends itself to miscibility via intermolecular bonding such as the hydrogen bonds. On the basis of factors like the pour or freezing point, stability, hazard, price, efficiency of lubrication, and compatibility with the perfluorocarbon-based grease, tri-(n-butyl) phosphate was chosen, and then the more preferably tri-(2-ethylhexyl) phosphate was chosen, for the formulation of TW-25.

DESCRIPTION OF THE PREFERRED EMBODIMENT

In a preferred embodiment, an extreme climate, semi-fluid lubricant comprises a homogeneous mixture of tri-(2-ethylhexyl) phosphate or tri-(n-butyl) phosphate in about 30 to 45 percent and preferably about 40 percent to about 44 percent by weight and the balance a grease comprising perfluorocarbon polymer in powder form suitable for use as a lubricant in combination with base oil and lubricant additives.

In the preferred extreme climate, semi-fluid lubricant, the grease comprises from about 5 percent to about 90 percent by weight of perfluorocarbon polymer particles in powder form suitable for use as a lubricant and from about 5 to 90 percent tricresyl phosphate.

In one extreme climate, semi-fluid lubricant, the grease comprises about 50 percent by weight of perfluorocarbon polymer particles and about 50 percent by weight of tricresyl phosphate as the base oil.

In one embodiment of the extreme climate, semi-fluid lubricant the grease comprises about 50 percent by weight of perfluorocarbon polymer particles and about 50 percent by weight of trimethylolpropane as the base oil.

In one preferred embodiment of the extreme climate, semi-fluid lubricant grease comprises about 50 percent perfluorocarbon polymer in powder form suitable for use as a lubricant and about 25 percent trimethylolpropane and 25 percent tricresyl phosphate and grease additives. In that embodiment, the grease comprises about 49 percent of the powder and about 24 percent of trimethylolpropane and about 24 percent of tricresyl phosphate.

In one preferred form of the invention, an extreme climate semi-fluid lubricant comprises a homogeneous mixture of tri-(2-ethylhexyl) phosphate in about 40 to 44 percent by weight and the balance a thixotropic lubricant containing perfluorocarbon polymer in powder form suitable for use as a lubricant and base oil.

In that preferred embodiment of the extreme climate semi-fluid lubricant, the thixotropic lubricant comprises about 25 percent of perfluorocarbon polymer in a powder form and the remainder dibasic acid ester as the base oil, plus grease additives.

Preferably, the dibasic acid ester is bis(2-ethylhexyl) sebacate and a lithium soap added in sufficient quantity to provide body sufficient to hold a shape of the thixotropic lubricant.

In one preferred extreme climate semi-fluid lubricant of the invention the thixotropic lubricant comprises about 20 to about 55 percent by weight perfluorocarbon polymer and a base oil which is a mixture of dibasic acid ester, aryl phosphate ester, and trimethyloalkane.

Preferably, the dibasic acid ester is bis(2-ethylhexyl) sebacate, and aryl phosphate ester is tricresyl phosphate, and the trimethyloalkane is trimethylopropane.

The present invention provides a semi-fluid general purpose lubricant comprising an intimate mixture of about 1 to about 99 percent by weight of trialkyl phosphate having a freezing point below about −20 degrees Centigrade or a pour point below about zero degrees Centigrade and the balance comprising a thixotropic lubricant containing a perfluorocarbon polymer in powder form suitable for use as a lubricant and base oil.

Preferably, the semi-fluid general purpose lubricant trialkyl phosphate is tri-(2-ethylhexyl) phosphate.

In the preferred semi-fluid general purpose lubricant the trialkyl phosphate is present in the range of from about 25 percent to about 50 percent by weight and the balance is the thixotropic lubricant.

Preferably in the semi-fluid general purpose lubricant the trialkyl phosphate is present in the range of from about 40 percent to about 44 percent by weight, and the balance is the thixotropic lubricant.

The preferred semi-fluid general purpose lubricant has a thixotropic lubricant which contains perfluorocarbon polymer in powder form suitable for use as a lubricant and base oil selected from the group of base oils comprising a dibasic acid ester or a mixture of a dibasic acid ester, an aryl phosphate ester, and a trimethyloalkane.

In the preferred semi-fluid general purpose lubricant, the perfluorocarbon polymer is present in the range of from about 20 to about 55 percent by weight of the thixotropic lubricant.

In the preferred semi-fluid general purpose lubricant, the base oil is a mixture of about equal parts of tricresyl phosphate and trimethylolpropane and about 50% of the thixotropic lubricant is perfluorocarbon.

In the preferred semi-fluid general purpose lubricant, about 50% of the thixotropic lubricant is perfluorocarbon polymer particles in a size range of about 1 preferably 3 to about 20 microns.

Preferably, the semi-fluid general purpose lubricant wherein the trialkyl phosphate is tri-(2-ethylhexyl) phosphate.

The preferred base grease is T-6 because of its unique composition and because of its unique properties of thick film hydrodynamic lubrication and thin film boundary lubrication. Other grease may be used that meets the requirements of the varied temperature operations, but the attributes and objects of the present invention are best supplied with the T-6 Tribophysics lubricant.

Any trialkyl phosphate may be used provided it has a pour point of below zero degrees Centigrade or a freeze point below −20 degrees Centigrade. Lower freezing and pour points are preferred. Specifically, tri-(n-butyl) phosphate, TnBP, is one preferred trialkyl phosphate. This is the tertiary ester of phosphoric acid with n-butyl alcohol. It has the following properties: FW 266.32, b.p. 292° C., f.p. below −80° C., pour point −54° C., flash point 146° C .(COC), sp.gr. 0.978, wt/gal 8.19 lbs, refractive index 1.4226 at 25 C, kinematic viscosity 2.68 mm(2)/s at 38° C., and a tolerance level of 5 mg/cubic meter of air in hazard consideration. The technical grade used was a colorless, odorless liquid. It may be obtained in 1-gal cans, 5-, 55-gal drums or tank cars.

T-6 Grease is manufactured by Tribophysics Corporation. It contains fresh ground perfluorocarbon polymer particles of 2-30, and preferably 3–15, microns in size in a base oil, which is made up of tricresyl phosphate and trimethylolpropane. Small amounts of protection agents such as zinc dinonylnaphthalene sulfonate and a diamyldithiocarbamate are present.

In the present invention, the compatibility of ingredients must be considered. The T-6 grease is compatible with TnBP. Tricresyl and tri-(n-butyl) phosphates are mutually soluble. TnBP forms hydrogen bonds to the three hydroxyl groups of trimethylolpropane and coordinates with the metal ions of the multifunctional protection agents. Thus, intimate mixing of all the ingredients is achieved.

EXAMPLE

In a glass vial was placed 102.6 grams of T-6 grease. To it was added 80.4 grams of TnBP, and the mixture was shaken vigorously to form a semi-fluid which displayed the body consistency of that of LSAT at room temperature. The sample contained about 170 grams. The % by weight of TnBP in the sample is 43.9%.

The preferred range of TnBP appropriate for mixing with T-6, using ordinary laboratory mixing device, is from about 25 % to about 45% by weight. Samples were prepared with those ratios. After subjecting these samples to −78° C. overnight, the 25% sample was more like T-6, being on the stiff side, and the 45% sample was very soft. The latter was too liquidy at room temperature, however. The optimum range for TnBP is between 40%–44% in order to realize the maximum benefits of this additive while keeping a consistent body like LSAT as a semi-fluid lubricant. With high speed/shear blending process, the upper end of this range may go even higher.

The present invention is preferably made by the following methodology in laboratory scale on a 100% weight basis. A batch process proceeds as follows. Weight out 56–60% by weight of T-6 into a container of adequate size. Add 44–40% by weight of TnBP. Work the liquid TnBP into the solid T-6. Homogenize the mixture by vigorous mechanical shaking or blending at room temperature.

Preferably, the liquid is sheared into the T-6 by a high speed mixer-blender.

While the invention initially used one embodiment in which TnBP was used with the T-6 grease, further work on the invention resulted in a new preference for T2EHP, which does not degrade plastic, rubber or metal and which adds more water repellance to the TW-25 product. The new product is odorless and adheres and penetrates better and is less subject to water washout.

Specifically, tri-(2-ethylhexyl) phosphate, T2EHP, is preferred. This is the tertiary ester of phosphoric acid with 2-ethylhexyl alcohol. The technical grade used was a colorless, odorless liquid. It has the following properties: FW 434, b.p. 220° C. (5 mm mercury), f.p. below −75° C., pour point −74° C., flash point 405 F (COC), sp.gr. 0.926, wt/gal 7.70 lbs, kinematic viscosity 7.98 mm(2)/s at 38° C., and low toxicity. It may be obtained in 1-gal. cans 5 or 55 gal.

the T-6 grease is compatible with T2EHP. Tricresyl and tri-(2-ethylhexyl) phosphates are mutually soluble. Tri-(2-ethylhexyl) phosphate forms hydrogen bonds to the three hydroxyl groups of trimethylolpropane and coordinates with the metal ions of the multifunctional protection agents. Thus, intimate mixing of all the ingredients is achieved.

EXAMPLE

In a glass vial place 100 grams of T-6 grease. To it add 80 grams of T2EHP and shake the mixture vigorously to form a semi-fluid which displays the body consistency of that of LSAT at room temperature. The sample contained about 180 grams. The % by weight of T2EHP in the sample is about 44%.

The preferred range of T2EHP appropriate for mixing with T-6, using ordinary laboratory mixing device, is from about 25% to about 45% by weight. Samples were prepared with those ratios. After subjecting these samples to −78° C. overnight, the 25% sample was more like T-6, being on the stiff side, and the 45% sample was very soft. The latter was too liquidy at room temperature, however. The optimum range for T2EHP is between about 40%–44% in order to realize the maximum benefits of this additive while keeping a consistent body like LSAT as a semi-fluid lubricant. With high speed/shear blending process, the upper end of this range may go even higher.

The present invention is preferably made by the following methodology in laboratory scale on a 100% weight basis. A batch process proceeds as follows. Weight out 56–60% by weight of T-6 into a container of adequate size. Add 44–40% by weight of T2EHP. Work the liquid T2EHP into the solid T-6. Homogenize the mixture by vigorous mechanical shaking or blending at room temperature.

Preferably, the liquid is sheared into the T-6 by a high speed mixer-blender.

While the invention has been described with reference to preferred embodiments, the scope of the invention is defined in the following claims.

I claim:

1. An extreme climate, semi-fluid lubricant comprising an intimate mixture of about 25% to 60% by weight of a trialkyl phosphate having a freezing point below about −20 degrees C. and the balance a grease comprising (a) perfluorocarbon polymer in powder form suitable for use as a lubricant in combination with (b) base oil and (c) lubricant additives.

2. The extreme climate, semi-fluid lubricant of claim 1 wherein the grease comprises from about 5 percent to about 90 percent by weight of perfluorocarbon polymer particles in powder form suitable for use as a lubricant and from 5 to 90 percent base oil which contains tricresyl phosphate and trimethylolpropane.

3. The extreme climate, semi-fluid lubricant of claim 1 wherein the grease comprises about 50 percent by weight of perfluorocarbon polymer particles and about 50 percent by weight of tricresyl phosphate as the base oil.

4. The extreme climate, semi-fluid lubricant of claim 1 wherein the grease comprises about 50 percent by weight of perfluorocarbon polymer particles and about 50 percent by weight of trimethylolpropane as the base oil.

5. An extreme climate semi-fluid lubricant as claimed in claim 1 wherein the grease comprises about 50 percent perfluorocarbon polymer in powder form suitable for use as a lubricant and about 25 percent trimethylolpropane and 25 percent tricresyl phosphate and grease additives.

6. The extreme climate semi-fluid lubricant of claim 5 wherein the grease comprises about 49 percent of the perfluorocarbon polymer and about 24 percent of trimethylolpropane and about 24 percent of tricresyl phosphate.

7. An extreme climate semi-fluid lubricant comprising an intimate mixture of trialkyl phosphate having a freezing point below −20 degrees Centigrade about 30 to 44 percent by weight and the balance of thixotropic lubricant grease containing (a) perfluorocarbon polymer in powder form suitable for use as a lubricant and (b) base oil.

8. The extreme climate semi-fluid lubricant of claim 7 wherein the thixotropic lubricant comprises 25 percent of perfluorocarbon polymer in a powder form and the remainder dibasic acid ester as the base oil.

9. The extreme climate semi-fluid lubricant of claim 8 wherein the dibasic acid ester is bis(2-ethylhexyl) sebacate and a lithium soap added in sufficient quantity to provide body sufficient to hold a shape of the thixotropic lubricant.

10. The extreme climate semi-fluid lubricant of claim 7 wherein the thixotropic lubricant comprises about 50 percent by weight perfluorocarbon polymer and a base oil which is a mixture of dibasic acid ester, aryl phosphate ester, and trimethyloalkane.

11. The extreme climate semi-fluid lubricant of claim 10 wherein the dibasic acid ester is bis(2-ethylhexyl) sebacate, wherein the aryl phosphate ester is tricresyl phosphate, and wherein the trimethyloalkane is trimethylopropane.

12. A semi-fluid general purpose lubricant comprising an intimate mixture of about 1 to about 99 percent by weight of trialkyl phosphate having a freezing point below about −20 degrees Centigrade or a pour point below about zero degrees Centigrade and the balance comprising a thixotropic lubricant containing (a) a perfluorocarbon polymer in powder form suitable for use as a lubricant and (b) base oil.

13. The semi-fluid general purpose lubricant of claim 12 wherein the trialkyl phosphate is tri-(n-butyl) phosphate.

14. The semi-fluid general purpose lubricant of claim 12 wherein the trialkyl phosphate is tri-(2-ethylhexyl) phosphate.

15. The semi-fluid general purpose lubricant of claim 12 wherein the trialkyl phosphate is present in the range of from about 25 percent to about 50 percent by weight and the balance is the thixotropic lubricant.

16. The semi-fluid general purpose lubricant of claim 12 wherein the trialkyl phosphate is present in the range of from about 30 percent to about 44 percent by weight and the balance is the thixotropic lubricant.

17. The semi-fluid general purpose lubricant of claim 12 wherein the thixotropic lubricant contains perfluorocarbon polymer in powder form suitable for use as a lubricant and base oil selected from the group of base oils comprising a dibasic acid ester and a mixture of a dibasic acid ester, an aryl phosphate ester and a trimethylolalkane.

18. The semi-fluid general purpose lubricant of claim 17 wherein the perfluorocarbon polymer is present in the range of from about 20 to about 55 percent by weight of the thixotropic lubricant.

19. The semi-fluid general purpose lubricant of claim 18 wherein the base oil is a mixture of about equal parts of tricresyl phosphate and trimethylolpropane and about 50% of the thixotropic lubricant is perfluorocarbon.

20. The semi-fluid general purpose lubricant of claim 17 wherein the base oil is bis(2-ethylhexyl) sebacate.

21. The semi-fluid general purpose lubricant of claim 17 wherein about 50% of the thixotropic lubricant is perfluorocarbon polymer particles in a range of about 1 to about 20 microns.

22. The semi-fluid general purpose lubricant of claim 17 wherein the trialkyl phosphate is tri-(n-butyl) phosphate.

23. The semi-fluid general purpose lubricant of claim 17 wherein the trialkyl phosphate is tri-(2-ethylhexyl) phosphate.

24. The semi-fluid general purpose lubricant comprising an intimate mixture of about 25 to 60 percent by weight of trialkyl phosphate having a freezing point below about −20 degrees Centigrade or a pour point below about zero degrees Centigrade and the balance comprising a thixotropic lubricant, wherein the thixotropic lubricant contains perfluorocarbon polymer in powder form suitable for use as a lubricant and base oil selected from the group of base oils consisting of a dibasic acid ester, a mixture of an aryl phosphate ester and a trimethylolalkane, or a mixture of a dibasic acid ester, an aryl phosphate ester and a trimethylolalkane.

25. The semi-fluid general purpose lubricant of claim 24 wherein the trialkyl phosphate is tri-(2-ethylhexyl) phosphate.

26. The semi-fluid general purpose lubricant of claim 24 wherein the trialkyl phosphate is tri-(n-butyl) phosphate.

27. The semi-fluid general purpose lubricant of claim 24 wherein the trialkyl phosphate is present in the range of from about 40 percent to about 44 percent by weight and the balance is the thixotropic lubricant.

28. An extreme climate, semi-fluid lubricant comprising a homogenous mixture of tri-(n-butyl) phosphate in about 25 percent to about 45 percent by weight and the balance a grease comprising (a) perfluorocarbon polymer in powder form suitable for use as a lubricant in combination with (b) base oil selected from the group of base oils consisting of a dibasic acid ester, a mixture of an aryl phosphate ester and a trimethylolalkane, or a mixture of dibasic acid ester, an aryl phosphate ester and a trimethylolalkane.

29. An extreme climate, semi-fluid lubricant comprising a homogenous mixture of tri-(2-ethylhexyl) phosphate in about 25 percent to about 45 percent by weight and the balance a grease comprising (a) perfluorocarbon polymer in powder form suitable for use as a lubricant in combination with (b) base oil selected from the group of base oils consisting of a dibasic acid ester, a mixture of an aryl phosphate ester and a trimethylolalkane, or a mixture of dibasic acid ester, an aryl phosphate ester and a trimethylolalkane.

30. An extreme climate semi-fluid lubricant comprising a homogenous mixture of tri-(n-butyl) phosphate in about 25 to 60 percent by weight and the balance a thixotropic lubricant grease containing (a) perfluorocarbon polymer in powder form suitable for use as a lubricant and (b) base oil selected from the group of base oils consisting of a dibasic acid ester, a mixture of an aryl phosphate ester and a trimethylolalkane, or a mixture of a dibasic acid ester, an aryl phosphate ester and a trimethylolalkane.

31. An extreme climate semi-fluid lubricant comprising a homogenous mixture of tri-(2-ethylhexyl) phosphate in about 25 to 60 percent by weight and the balance a thixotropic lubricant grease containing (a) perfluorocarbon polymer in powder form suitable for use as a lubricant and (b) base oil selected from the group of base oils consisting of a dibasic acid ester, a mixture of an aryl phosphate ester and a trimethylolalkane, or a mixture of a dibasic acid ester, an aryl phosphate ester and a trimethylolalkane.

* * * * *